US009451863B1

(12) United States Patent
Larson et al.

(10) Patent No.: US 9,451,863 B1
(45) Date of Patent: Sep. 27, 2016

(54) WINE GLASS POLISHER

(71) Applicants: Jeffrey Larson, Lawrenceville, GA (US); Danielle L. W. Barringer, Suwanee, GA (US); Jerry Vance Foster, III, Lawrenceville, GA (US); David M. W. Hemming, Atlanta, GA (US); Jonathan Schweiger, Atlanta, GA (US); Noah McNeely, Grayson, GA (US)

(72) Inventors: Jeffrey Larson, Lawrenceville, GA (US); Danielle L. W. Barringer, Suwanee, GA (US); Jerry Vance Foster, III, Lawrenceville, GA (US); David M. W. Hemming, Atlanta, GA (US); Jonathan Schweiger, Atlanta, GA (US); Noah McNeely, Grayson, GA (US)

( * ) Notice: Subject to any disclaimer, the term of this patent is extended or adjusted under 35 U.S.C. 154(b) by 0 days.

(21) Appl. No.: 13/870,526

(22) Filed: Apr. 25, 2013

Related U.S. Application Data

(63) Continuation-in-part of application No. 12/817,655, filed on Jun. 17, 2010, now Pat. No. 8,506,360.

(60) Provisional application No. 61/221,834, filed on Jun. 30, 2009.

(51) Int. Cl.
*B24B 7/00* (2006.01)
*A47L 15/00* (2006.01)

(52) U.S. Cl.
CPC ..... *A47L 15/0065* (2013.01)

(58) Field of Classification Search
USPC ..... 451/64, 67
See application file for complete search history.

(56) References Cited

U.S. PATENT DOCUMENTS

| | | | | |
|---|---|---|---|---|
| 4,185,419 | A * | 1/1980 | Ilk | 451/44 |
| 5,010,660 | A * | 4/1991 | Hambleton et al. | 34/92 |
| 8,083,999 | B2 * | 12/2011 | Busujima | 422/298 |
| 2005/0236345 | A1 * | 10/2005 | Herbst et al. | 211/41.9 |
| 2008/0283099 | A1 * | 11/2008 | Peukert | A47L 15/4291 134/99.1 |

* cited by examiner

*Primary Examiner* — Joseph J Hail
*Assistant Examiner* — Shantese McDonald
(74) *Attorney, Agent, or Firm* — Kenneth L Tolar

(57) ABSTRACT

A wine-glass polisher includes a housing having at least one cleaning chamber defined by a bottom wall and at least one sidewall. Extending from the sidewall is a wine-glass holder including a horizontal arm having a C-shaped gripping member at a distal end for holding the stem of an inverted wine glass. Immediately above the gripping member is a motorized disc for engaging the base of a wine glass to rotate it during a cleaning and drying cycle. Mounted on the sidewall, below the wine-glass holder, is an upper dispensing nozzle for projecting either drying air or steam onto the exterior surface of a wine glass. Upwardly extending from the bottom wall of the cleaning chamber is a lower dispensing nozzle for projecting drying air or hot water onto the interior surface of a wine glass. Hot water and air are sequentially delivered to the nozzles to clean and subsequently dry a wine glass.

7 Claims, 4 Drawing Sheets

WINE GLASS POLISHER

CROSS REFERENCE TO RELATED APPLICATIONS

This application is a continuation-in-part of application Ser. No. 12/817,655 which claimed priority of provisional application No. 61/221,834 filed on Jun. 30, 2009, the specifications of which are both incorporated herein by reference.

BACKGROUND OF THE INVENTION

The present invention relates to a wine-glass polisher.

DESCRIPTION OF THE PRIOR ART

Properly cleaning wine glasses has always been arduous and time-consuming. After the glass has been cleansed with soap and water, stains normally form as the glass dries. As a result, the glass must be steamed and then manually polished with a towel to remove the stains. The procedure is not only time-consuming, but also leads to glass breakage and personal injuries when a worker inserts his or her hand into the glass. Accordingly, there is currently a need for an easier method of cleaning and polishing wine glasses. The present invention addresses this need by providing a cleaning device that automatically steams and dries wine glasses to remove stains.

SUMMARY OF THE INVENTION

The present invention relates to a wine-glass polisher including a housing having at least one cleaning chamber defined by a bottom wall and at least one sidewall. Extending from the sidewall is a wine-glass holder including a horizontal arm having a C-shaped gripping member at a distal end for receiving the stem of an inverted wine glass. Immediately above the gripping member is a motorized disc for engaging the base of a wine glass to rotate it during a cleaning and drying cycle. Mounted on the sidewall, below the wine-glass holder, is an upper dispensing nozzle for projecting either drying air or steam onto the exterior surface of a wine-glass beverage compartment. Upwardly extending from the bottom wall of the cleaning chamber is a lower dispensing nozzle for projecting drying air or hot water into the beverage compartment interior.

To polish a wine glass, a user first invertibly positions the glass within the gripping member and initiates an automated polishing cycle. The motorized disc begins rotating the inverted wine glass as steam or hot water is delivered to the upper and lower nozzles to uniformly clean both the interior and exterior surfaces of the glass. After a predefined rinsing duration, the hot water distribution system is automatically disabled and the air blower is activated for a second predetermined duration. Air exiting both the upper and lower nozzles forces water downwardly, off the glass, to dry both the interior and exterior surfaces thereof. After a third predefined duration, the air blower is deactivated and the wine glass is ready for use.

It is therefore an object of the present invention to provide a device that automatically polishes a wine glass.

It is another object of the present invention to provide a glass polisher that quickly, safely and easily polishes a wine glass.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
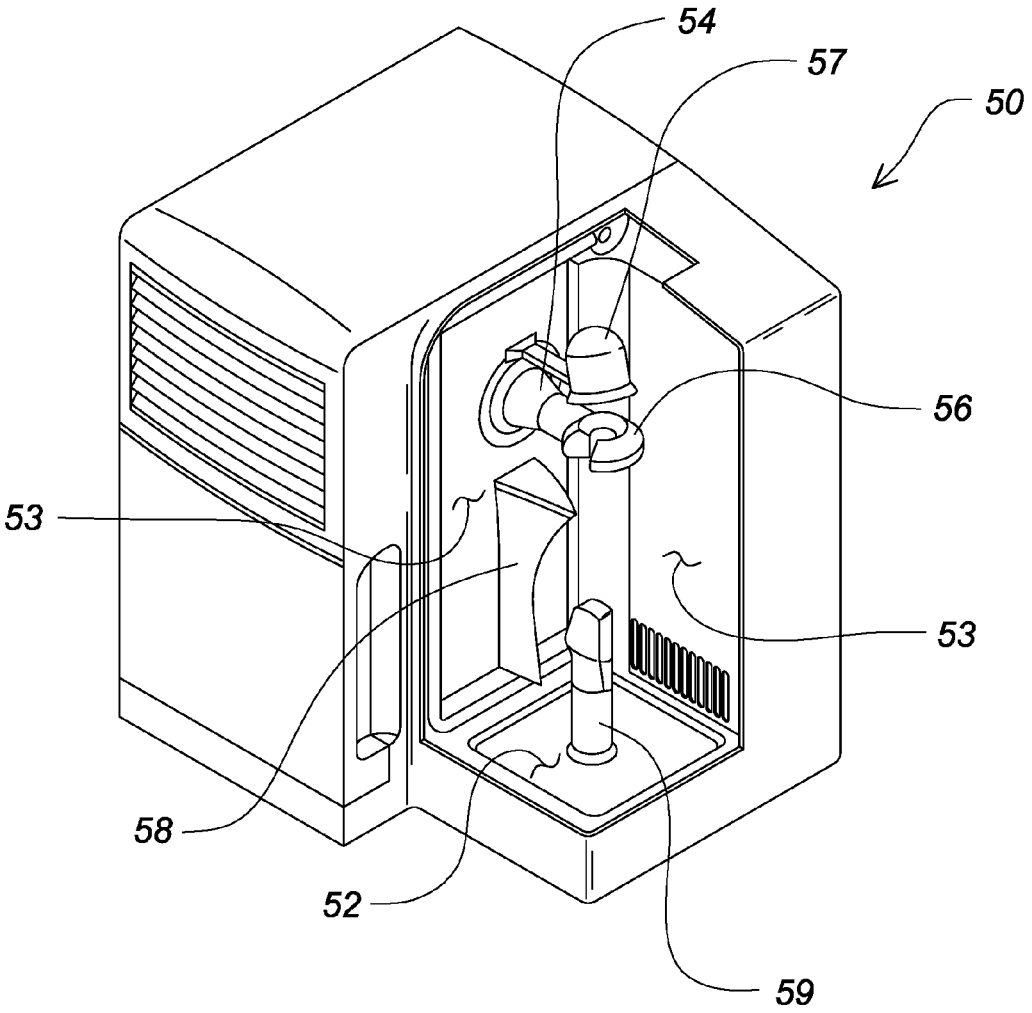
FIG. 1 is a perspective view of the wine-glass polisher according to a first embodiment of the present invention.
Figure 2:
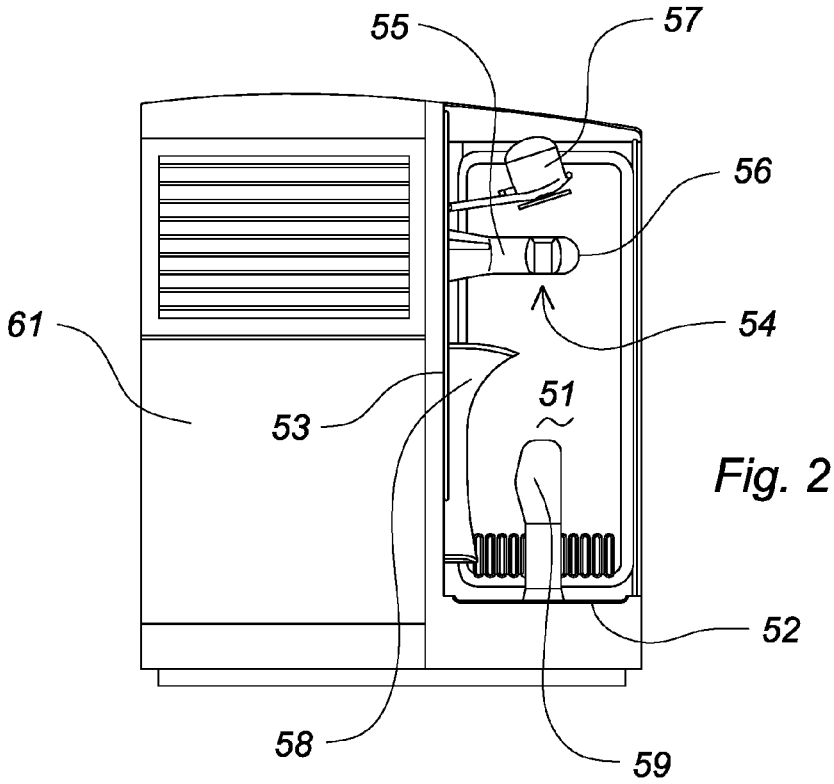
FIG. 2 is a front, plan view of the polisher of FIG. 1.
Figure 3:
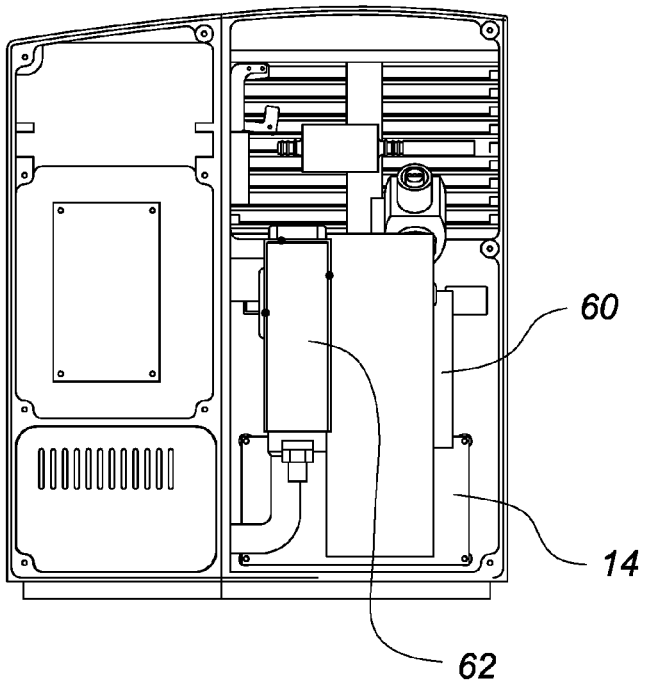
FIG. 3 is a rear, sectional view of the polisher of FIGS. 1 and 2.
Figure 4:
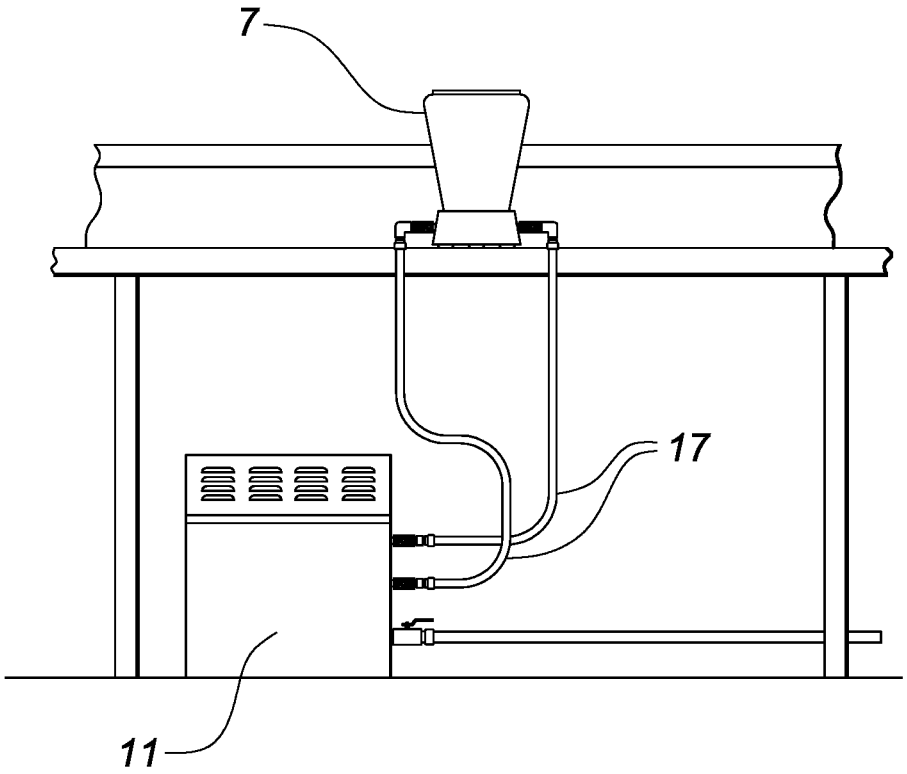
FIG. 4 is a plan view of the glass polisher according to a second embodiment of the present invention.
Figure 5:
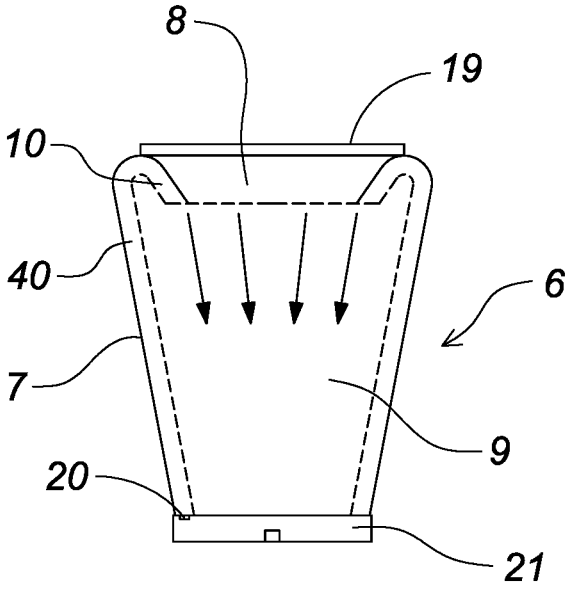
FIG. 5 is a front, cross-sectional view of the cleaning chamber of the embodiment of FIG. 4.
Figure 6:
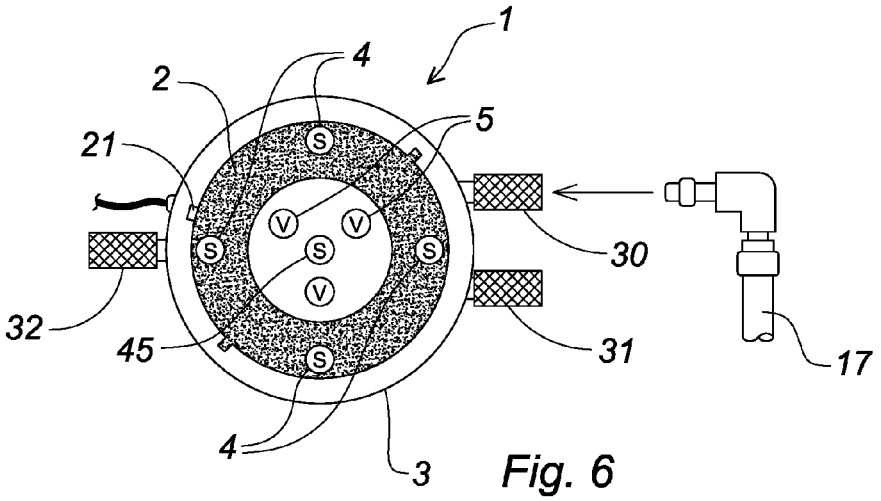
FIG. 6 is a top view of the base unit of the embodiment of FIGS. 4 and 5.
Figure 7:
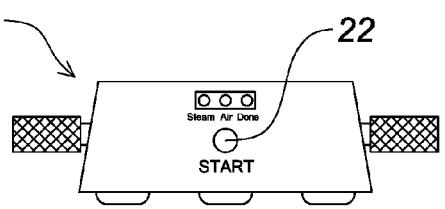
FIG. 7 is a side view of the base unit.
Figure 8:
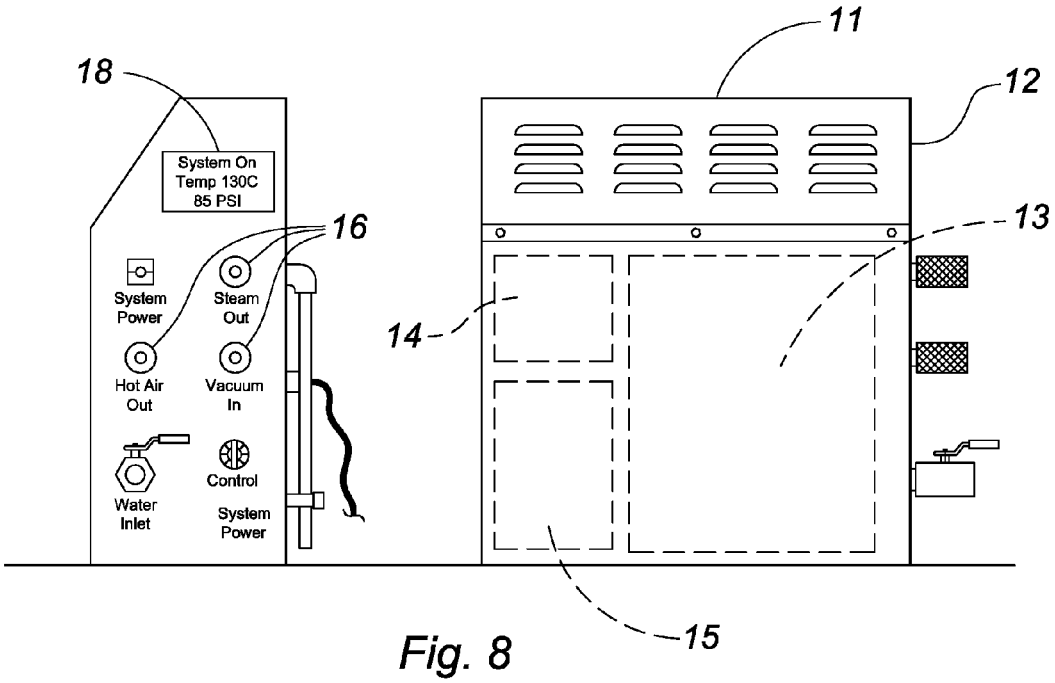
FIG. 8 is an isolated view of the cleaning unit.

Now referring specifically to FIGS. 1-3, a first embodiment of the present invention relates to a wine-glass polisher comprising a housing 50 having at least one cleaning chamber 51 defined by a bottom wall 52 and at least one sidewall 53. Extending from the sidewall is a wine-glass holder 54 including a horizontal arm 55 having a C-shaped gripping member 56 at a distal end for holding the stem of an inverted wine glass. Immediately above the gripping member is a motorized disc 57 for frictionally engaging the base of a wine glass to rotate it during a cleaning and drying cycle.

Mounted on the sidewall, below the wine-glass holder, is an upper dispensing nozzle 58 for projecting either drying air or steam onto the exterior surface of a wine-glass beverage compartment. Upwardly extending from the bottom wall of the cleaning chamber is an elongated, lower dispensing nozzle 59 for projecting drying air or hot water into the wine-glass interior. The upper and lower nozzles each include vanes that are oriented to force moisture down the exterior and interior surfaces of the wine glass.

Within the housing interior is an air and hot-water or steam distribution system in fluid communication with the upper and lower nozzles. The air distribution system is preferably a motorized blower 60 having a pair of outlet tubes that are each directed toward either the upper or lower nozzle. The hot-water distribution system includes a pump for delivering water from an internal reservoir 61 to a heater 62 that preferably warms the water to a temperature immediately below the boiling point. A computer 14 controls the operation of the pump, heater and blower as necessary to initiate and terminate a drying or cleaning cycle as described below.

To polish a wine glass, a user first invertibly positions the glass within the gripping member and initiates an automated polishing cycle by actuating a select control button (not pictured). The motorized disc begins rotating the inverted wine glass as steam or hot water is delivered to the upper and lower nozzles to uniformly clean both the interior and exterior surfaces of the glass. After a predefined rinsing duration, the hot-water distribution system is automatically disabled and the air blower is activated for a second predetermined duration. Air exiting both the upper and lower nozzles forces water downwardly, off the inverted glass, to dry both the interior and exterior surfaces thereof. The specially-configured nozzles minimize spotting that is typically caused by evaporative drying. After a third predefined duration, the air blower is deactivated and the wine glass is ready for use.

Now referring to FIGS. 4-8, a second embodiment includes a base unit 1 having an upper surface 2, a lower surface and an outer periphery 3. On the upper surface are a plurality of apertures each in fluid communication with one of three inlets 3 on the unit's periphery. A first set of apertures 4 are in fluid communication with both a hot air inlet port 30 and a steam inlet port 31 while a second set 5 are in discrete fluid communication with a vacuum port 32.

Removably fastened to the base unit is a frustoconical cleaning chamber 6 having a mesh bottom surface, a continuous outer wall 7 and an open top 8 in communication with an interior compartment 9. The interior compartment is dimensioned to accommodate any conventional wine glass in an upright or inverted orientation. Within the outer wall is at least one channel 40 that is in fluid communication with the hot air port 30 and steam port 31 when the chamber is properly mounted on the base unit. The open top is defined by an annular, U-shaped baffle 10 in communication with the channel 40 that directs steam and hot air downwardly toward a wine glass below. A central aperture 45 is also in communication with the ports 30,31 to cleanse and dry the interior surface of the glass.

A cleaning unit 11 includes a housing 12 having a steam generator 13, a heated air blower 14 and a vacuum pump 15 received therein, each of which is in discrete communication with a designated outlet port 16 on the housing exterior. The steam generator includes a water reservoir having an electronic level sensor that disables the generator if the fluid level is below a predetermined threshold. An insulated steam reservoir includes pressure and temperature sensors for maintaining steam at a desired temperature and pressure while a safety relief valve releases steam if the temperature or pressure exceeds a recommended level. A color-coded hose 17 is connected to each one of the outlet ports and to a corresponding inlet port on the base unit using quick-connect fittings. A controlling computer actuates the vacuum pump or a solenoid on either of the hot air hose or the steam hose to initiate a drying cycle or steaming cycle as described below. An LCD 18 depicts the current status and operational parameters of any polishing cycle.

The open top of the chamber includes a circumferential optical sensor 19 that disables the steam generator or air blower if a person inserts a hand or other opaque object into the cleaning chamber during operation. An electrical connector 20 on the chamber bottom surface mates with a second connector on the base unit 21 to power the sensor.

To polish a wine glass, a user inverts the glass, positions it in the cleaning chamber and initiates a polishing cycle by depressing a START 22 button on the base unit. Steam is delivered to the circumferential channel where the baffle directs the steam downwardly to blanket the glass exterior and stem. Simultaneously, steam is projected from the central aperture 45 into the glass interior. The vacuum pump operates simultaneously to remove the steam and any condensation from the cleaning chamber. After a predefined duration, the computer automatically disables the steam generator, and simultaneously activates the heated air blower for a predetermined duration to dry both the glass exterior and interior.

The above-described device is not limited to the exact details of construction and enumeration of parts provided herein. For example, the device depicted and described is primarily designed for commercial use; however, all of the above-described components could be downsized and incorporated into a single unit to provide a counter top polisher for home use. Furthermore, the polisher could also be used to polish other types of glasses or containers in addition to wine glasses. Finally, the size, shape, materials of construction and the number of cleaning chambers can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A wine-glass polisher comprising:

a housing having a cleaning chamber therein;

a wine-glass holder within said cleaning chamber for suspending a wine glass within said cleaning chamber;

a motorized disc within said cleaning chamber frictionally engaging the wine glass suspended by said holder that rotates said glass upon receipt of a predetermined command;

a hot water source in communication with said cleaning chamber;

an air source in communication with said cleaning chamber;

a controller means for initiating an automated polishing cycle, said automated polishing cycle including rotating said motorized disc, delivering hot water from said hot water source to said cleaning chamber for a first predetermined duration, and after said first predetermined duration, disabling delivery of hot water to said cleaning chamber and delivering air from said air source to said cleaning chamber for a second predetermined duration to dry said wine glass.

2. A glass polisher comprising:

a cleaning chamber having a wine glass holder therein;

means for delivering hot water to said cleaning chamber for a first predetermined duration;

means for delivering air to said cleaning chamber for a second predetermined duration to produce a dry, spotless glass;

an upper dispensing nozzle positioned within said cleaning chamber and in communication with said means for delivering hot water and said means for delivering air for projecting either of drying air and hot water onto the exterior surface of a wine glass.

3. The wine-glass polisher according to claim 2 wherein said wine-glass holder includes a horizontal arm having a gripping member at a distal end for receiving a stem of an inverted wine glass.

4. The wine glass polisher according to claim 3 further comprising a motorized disc above said gripping member and engaging a base of a wine glass to rotate said wine glass during a cleaning and drying cycle.

5. The wine-glass polisher according to claim 2 further comprising a lower dispensing nozzle positioned within said cleaning chamber and in communication with said means for delivering hot water and said means for delivering air to said cleaning chamber for projecting either of drying air and hot water onto an interior surface of a wine glass.

6. The wine-glass polisher according to claim 5 wherein said upper dispensing nozzle and said lower dispensing nozzle each include vanes that are oriented to force moisture down the exterior surface and the interior surface of the wine glass.

7. The wine-glass polisher according to claim 2 wherein said second predetermined duration begins after the expiration of said first predetermined duration.

* * * * *